United States Patent [19]

Nishi

[11] Patent Number: 4,572,089

[45] Date of Patent: Feb. 25, 1986

[54] EDGE TRIMMER FOR SEWING MACHINE

[75] Inventor: Naoichi Nishi, Sanjo, Japan

[73] Assignee: Nishi Manufacturing Co., Ltd., Niigata, Japan

[21] Appl. No.: 595,833

[22] Filed: Apr. 2, 1984

Related U.S. Application Data

[63] Continuation-in-part of Ser. No. 495,396, May 11, 1983, abandoned.

[30] Foreign Application Priority Data

Jun. 16, 1982 [JP] Japan ..... 57-089960[U]

[51] Int. Cl.[4] ..... D05B 37/06

[52] U.S. Cl. ..... 112/128

[58] Field of Search ..... 112/128, 122, 123

[56] References Cited

U.S. PATENT DOCUMENTS

| | | | |
|---|---|---|---|
| 187,064 | 2/1877 | Stroop | 112/128 |
| 212,602 | 2/1879 | Ingalls | 112/128 |
| 570,805 | 11/1896 | Jacobus | 112/128 |
| 618,977 | 2/1899 | Baumann | 112/128 |
| 2,021,700 | 11/1935 | Pugach | 112/128 |
| 2,443,369 | 6/1948 | Alifano et al. | 112/128 |
| 2,493,735 | 1/1950 | Alifano et al. | 112/128 |

*Primary Examiner*—H. Hampton Hunter

*Attorney, Agent, or Firm*—Wenderoth, Lind & Ponack

[57] ABSTRACT

There is an upper lever pivotably supported by an L-shaped arm of a stand positioned on a base or by a bended arm of a stand integral with a holder. One edge of the upper lever is movably fastened to a needle bar of a sewing machine by a needle clamping screw for fastening a needle to the needle bar through a needle clamp body concurrently while the other end thereof is pivotably connected to one of the projected arms of a lower lever through a connecting link. When the upper lever thus constructed oscillates in unison with an up and down motion of the needle bar of the sewing machine, a cutter which is fastened dependingly to the edge of the other projected cylindrical arm of the lower lever shifts up and down with the result that the cutter thereof touches slidably with a shearing edge defined along the front edge of the L-shaped arm portion of the base or a shearing plate fastened to the holder, thereby an edge of cloth materials fed by the feeding device of the sewing machine may be trimmed.

The projected cylindrical arm of the lower lever having a cutter at the edge thereof consists of two cylinders one of which is a slidable cylinder provided with a projection of a small diameter which is arranged to fit into or out of a bore of another cylinder by a biasing force curled around the projection of a small diameter whereby the shearing stress between the cutter and the shearing edge may be adjusted.

2 Claims, 10 Drawing Figures

EDGE TRIMMER FOR SEWING MACHINE

BACKGROUND OF THE INVENTION

1. Cross-Reference to Related Application

This application is a continuation-in-part of application Ser. No. 495,396 filed May 11, 1983 and now abandoned.

2. Field of the Invention

This invention relates to an edge trimmer for a sewing machine. More specifically the invention contemplates providing an edge trimer which is removably connected to a needle bar of a sewing machine as an attachment.

3. Description of the Prior Art

A conventional edge trimmer is usually fixed undetachably on a sewing machine bed and functions to trim and edge of the cloth fed by means of a feeding device such as a presser foot and a feed dog. The trimmer is so constructed as to trim the edge of the cloth by means of a pair of knives which pair is connected to a sewing machine mechanism to be driven thereby. This type of trimmer is usually adapted to a high speed sewing machine and is generally called "a sewing machine with a trimmer for industrial use". The trimmer involves complexities of a mechanism for the operation of the knives.

SUMMARY AND OBJECTS OF THE INVENTION

It is an object of this invention to provide an edge trimmer of a simple structure which is removably or detachably fitted to a needle bar of any type of sewing machine including one for domestic or industrial use and is designed to be operated smoothly in unison with an up and down movement of the needle bar of the sewing machine in operation.

In a conventional sewing machine with an edge trimming device, an adjustment of shearing stress of a pair of knives requires a lot of skill for an operator because of the complexities of the mechanism thereof.

It is another object of this invention to provide an edge trimmer whose adjustment of shearing stress of the device may be simply and easily performed.

In a conventional sewing machine, when a trimmer is fastened to a sewing machine bed or table, an extra attachment like guage plates are fitted on the table or the bed close to the edge trimmer to prevent the trimmer from being shifted. This prior art arrangement requires an extra attachment besides the trimmer and sometimes the trimmer is not positioned at a desired position without the extra attachment.

A further object of this invention is to present an edge trimmer integrally formed with an extended holder and only by fastening the holder to the bed or table, the edge trimmer can simultaneously be fitted on to the bed or table at any desired position. At the same time, the holder permits an operator to cut off any desired width of cloth materials fed forward under a cover plate of the holder by utilizing marks graduated on a front edge thereof as a scale for measuring trimming width.

Other and further objects of this invention will become clear upon an understanding of the illustrative embodiments about to be described or will be indicated in the appended claims, and various advantages not referred herein will occur to one skilled in the art upon employment of the invention in practice.

DETAILED DESCRIPTION OF THE INVENTION

Figure 1:
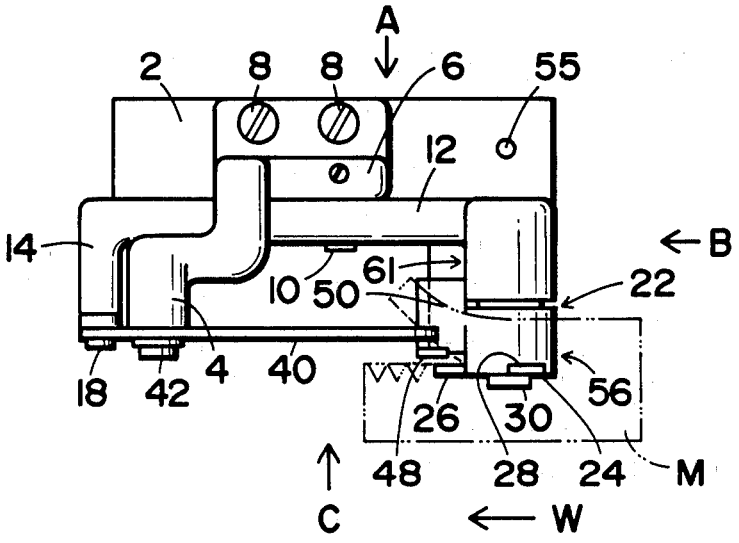
FIG. 1 is a plan view of a trimmer for a sewing machine embodying the invention.
Figure 2:
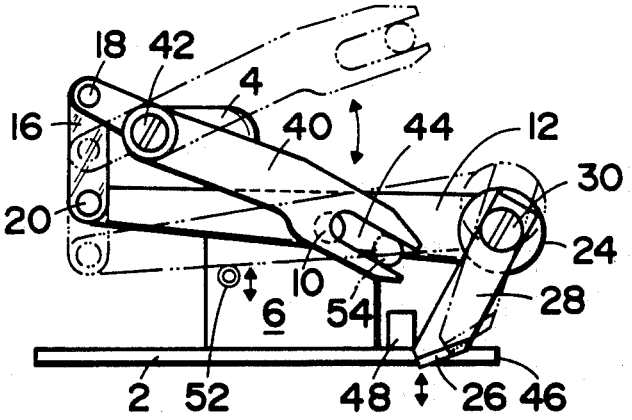
FIG. 2 is an elevation view of a trimmer as seen in the direction of an arrow C shown in FIG. 1.

Referring first to the embodiment of the invention shown in FIGS. 1 and 2, a vertical stand 6 having an L-shaped arm 4 is fastened to a base 2 by screws 8. A lower lever 12 which is fulcrummed on a pin or a screw 10 fitted through the stand 6 is formed in the shape of letter U having at its one end a projected arm 14 to an end of which is pivotably connected an end of the upper lever 40 by the medium of connecting link 16 which is pivoted at 18 to the upper lever 40 and at 20 to the lower lever 12. The U-shaped lower lever 12 is also provided at its other end with a projected cylindrical arm 22 to an end of which a depending cutter 28 having a cutter blade 26 at the end thereof is fastened by means of a screw 30. The upper lever 40 which is pivotably connected to an edge of the L-shaped arm 4 of the vertical stand 6 by a screw 42 is provided with a longitudinal U-shaped slot 44 in one end thereof through which a needle clamping screw 54 may be fastened. The base 2 is substantially shaped like a letter L with a portion 2' which is extending at a right angle towards the cylindrical lower arm 22 underneath thereof and in parallel therewith. Along a front edge of the portion 2' at the back of the cutter blade 26 of the cutter 28 is constituted a shearing edge 46.

Figure 3:
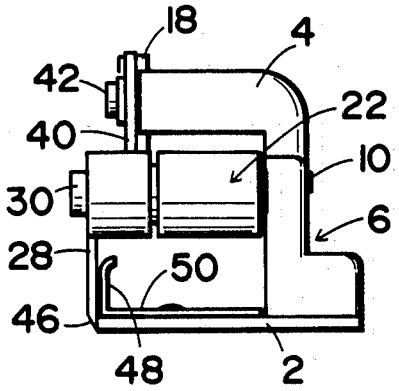
FIG. 3 is a side view of a trimmer as seen in the direction of an arrow B shown in FIG. 1.
Figure 4:
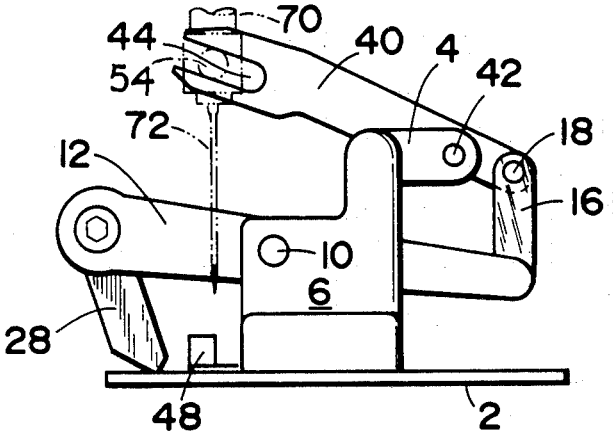
FIG. 4 is an elevation view with an oscillating upper lever lifted up, as seen in the direction of an arrow A shown in FIG. 1.

An oscillating movement of a needle bar 70 to which the upper lever 40 is pivotably attached, as shown in FIG. 4 and as will be explained hereinafter, transmits, through the connecting link 16 and the lower lever 12, an up and down movement of the cutter 28, sliding past the shearing edge 46 (FIGS. 2 and 3) of the base 2, whereby the cutter 28 and the shearing edge 46 function together to cut an edge of cloth materials M shown in FIG. 1.

As shown in FIGS. 1 and 3, a cloth guide means 50 having an upright guide wall 48 along the edge thereof is positioned on the arm portion 2' of the base 2 or is arranged in parallel and flush therewith. As shown in FIG. 2, a stopper 52 projected from the vertical lever stand 6 may stop the downwardmost movement of the lower lever 12 by touching the underside thereof, whenever the lower lever 12 moves up and down in unison with the movement of the upper lever 40 as will be explained hereinafter.

The device for adjusting a shearing stress created between the cutter blade 26 of the cutter 28 and the shearing edge 46 of the base arm portion 2' will now be explained hereunder.

Figure 5:
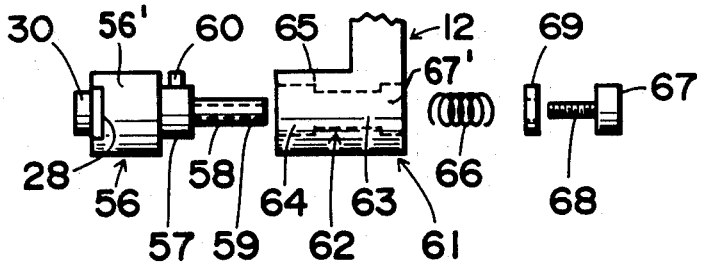
FIG. 5 is an exploded view of a cylindrical arm of the lower lever.

As shown in FIG. 1, the cylindrical arm 22 of the lower lever 12 comprises a cylindrical portion 61 and a slidable cylindrical projection 56 both of which have the same diameter. As shown in FIG. 5, the cylindrical projection 56 is received by a bore 62 of the cylindrical portion 61. The cutter 28 is fastened to the edge of the slidable cylindrical projection 56 by the screw 30. The slidable cylindrical projection 56 is provided with a head 56' from which the first cylindrical projection 57 having a smaller diameter than that of the head 56' is extended, and another cylindrical projection 58 having a smaller diameter than that of the projection 57 is also extended therefrom. A female threaded bore 59 is defined in the cylindrical projection 58. A pin or a projection 60 provided on the cylindrical projection 57 is arranged to be received by a slit 65 disposed in the cylindrical portion 61 as is shown in FIG. 5.

The cylindrical portion 61 is provided with a bore 62 extending therethrough. The bore 62 is provided with larger sections 64 and 67' at each end thereof. The former section 64 is arranged for receiving the cylindrical projection 57 while the latter section 67' is arranged for receiving a washer 69 and a nut 67 having a male screw 68, whenever the slidable cylindrical projection 56 is assembled with the cylindrical projection 61 to form a unit of cylindrical lever arm 22.

A slit 65 with an opening at the left, when seen facing FIG. 5, designed to receive the pin or the projection 60, is defined laterally in the edge of the cylindrical portion 61. A coil spring 66 may be curled around the smallest cylindrical projection 58 whenever the slidable cylindrical projection 56 is received by the cylindrical portion 61 for assembling therewith.

For assembling the two parts, the slidable cylindrical projection 56 and the cylindrical portion 61 into a unit, the former is pushed into the latter whereby two cylindrical projections 57 and 58 of the former may be engaged into the bore 62 with the projection 57 being positioned in the larger section 64 of the bore 62 simultaneously the pin 60 arranged thereon being shifted to the same direction to be engaged by the slit 65 while the projection 58 being shifted through the bore 62 with its end being positioned in the larger section 67' ready for receiving the coil spring 66 therearound.

By pushing the coil spring 66 into the bore 62 to be curled around the cylindrical projection 58 and by turning the nut 67, the male screw 68 may be threaded into the female threaded bore 59 of the projection 58 with the washer 69 being sandwiched between the coil spring 66 and the nut 67.

By tightening or loosening the nut 67 by the application of a screw driver or the like, the two projections 57 and 58 of the cylindrical projection 56 may be shifted deep into the bore 62 or vice versa within the lengthwise distance of the slit 65 into which the pin 60 or the projection is slidably engaged, whereby the coil spring 66 normally draws the cutter 28 toward the shearing edge 46 of the base arm portion 2' or vice versa. Thus the position of the cutter 28 relative to the shearing edge 46 (FIGS. 2 and 3) of the base 2 may be adjusted, as may be required by the various thickness or other conditions of cloth materials M (FIG. 1) to be worked upon.

Figure 6:
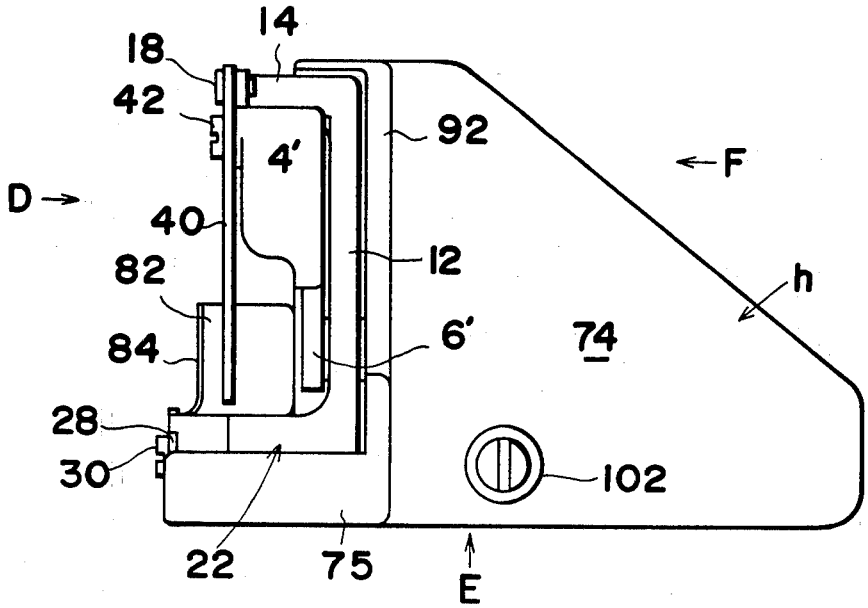
FIG. 6 illustrates a plan view of a modified edge trimmer of this invention having an extended holder.
Figure 7:
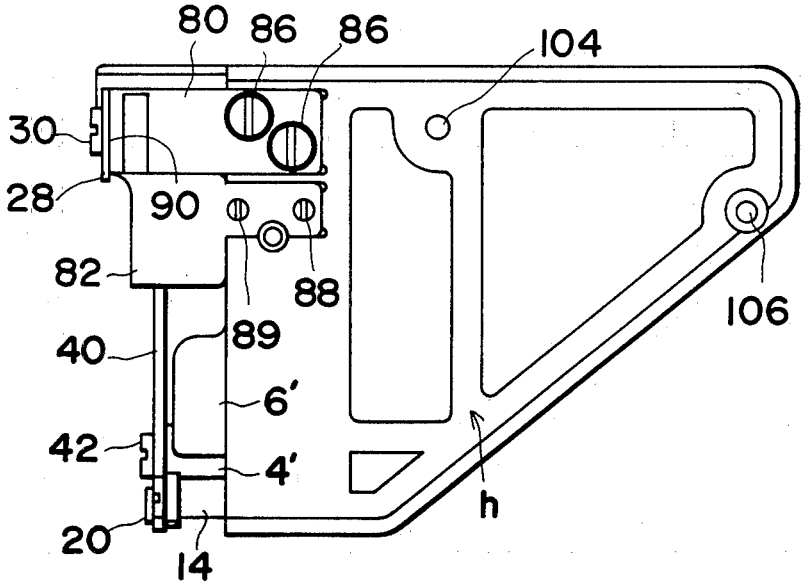
FIG. 7 is a bottom view of the modified trimmer shown in FIG. 6.

Referring next to FIG. 6, there is illustrated a modified structure of an edge trimmer according to this invention. The edge trimmer is not provided with the L-shaped base 2 with its portion 2' extending at a right angle therefrom toward the cylindrical lever arm 22 as heretofore explained. Instead, it is provided integrally with a holder h having a flat extended base 74 and a support wall 92, one end of which extends at a right angle parallel with the cylindrical arm 22 with a clearance therebetween to form a cover plate 75 which will be explained in detail hereinafter. Underside corner of the holder h, in parallel with the cylindrical arm 22, there are fastened an extending shearing plate 80 (being shown in FIG. 7 and corresponding to portion 2' of FIG. 2 and FIG. 3) and a cloth guide means 82, by means of screws 86 and 88 respectively as shown in FIG. 7. A shearing edge 90 is defined at the shearing plate 80 while the cutter 28 is arranged slidingly touchable to the shearing edge 90. The cloth guide means 82, provided with an upright wall 84, is arranged in parallel and flush with the shearing plate 80, as shown in FIGS. 6 and 7.

Figure 9:
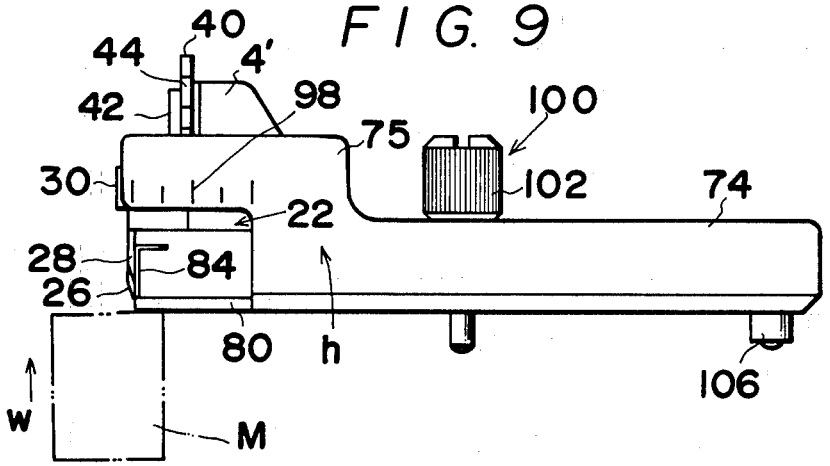
FIG. 9 illustrates a front view of the modified trimmer shown in FIG. 6 seen in the direction of an arrow E.

The support wall 92 of the holder h functions as a vertical stand 6' as heretofore explained, i.e., the wall 92 pivotably supports the lower lever 12 by means of a screw 94. The stand 6' being formed integral with the holder h is provided with an arm 4' bent to the edge of which the upper lever 40 is pivotably fastened. The cover plate 75, arranged to protect the cylindrical arm 22 from damage by leaving a clearance therebetween, has along its front edge scale-marks 98 graduated in equal increments as shown in FIG. 9.

A screw 100 with a knurled head 102 passes through a hole (not shown) defined in the holder base 74 to be threaded into a hole (not shown) defined in a sewing machine bed. A projection 106 is disposed under a side corner of the holder base 74, which is arranged to fit into a hole (not shown) defined in the sewing machine table (not shown). When the screw 100 and the projection 106 are fitted into holes predeterminedly defined in the sewing machine bed or table, the holder h together with the edge trimmer is fastened to the sewing machine table at a predetermined position.

It should be noted that in the modified form of edge trimmer heretofore explained, parts which are similar or equivalent to the parts of the first described trimmer shown in FIG. 1–FIG. 5 are indicated by the same reference numerals.

The operation of the edge trimmer of this invention will now be explained hereunder.

Figure 10:
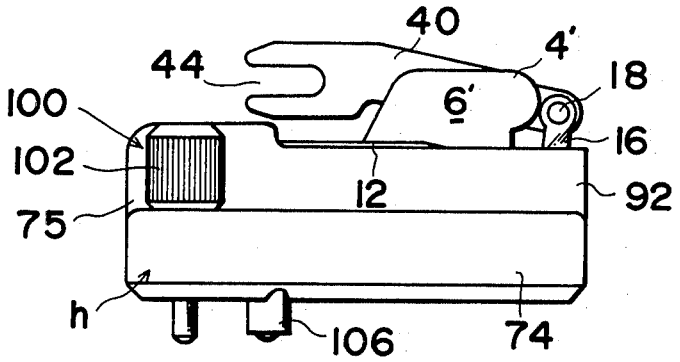
FIG. 10 illustrates another elevation view of the modified trimmer shown in FIG. 6, seen in the direction of an arrow F.

First of all, the trimmer shown in FIG. 1–FIG. 5 is usually unmovably arranged on a throat plate of a sewing machine bed (not shown) by fastening the base 2 to the sewing machine bed by means of a screw (not shown) fitted through a hole 55 (FIG. 1) with the upright guide wall 48 being located in parallel with one side of the feed dog (not shown) thereof to prevent the fastened trimmer from being shaken on the sewing machine bed or table in the direction of an arrow C or vice versa, as shown in FIG. 1. An extra attachment (not shown), for example, a gauge plate, is fastened onto the table or bed in parallel with and close to the base 2. However, the edge trimmer having a holder h (FIGS. 6–10) can be more easily fitted unmovably onto the sewing machine bed or the table without using any extra attachment like a gauge plate. This can be done by fastening the holder h to the sewing machine bed by means of both the screw 100 (FIGS. 9 and 10) threaded in the hole of the sewing machine bed and the projection 106 projecting underneath the holder h fitted into the hole defined in the sewing machine table.

The longitudinal slit 44 of the upper lever 40, as shown in FIG. 4, at its lifted position is fastened to a needle bar 70 by means of a needle clamping screw 54 which extends through the longitudinal slit 44 to fasten a needle 72 to a needle clamp body 73 concurrently whereby in unison with the motion of the needle bar 70 driven by a sewing machine mechanism, the upper lever 40 shifts accordingly.

Figure 8:
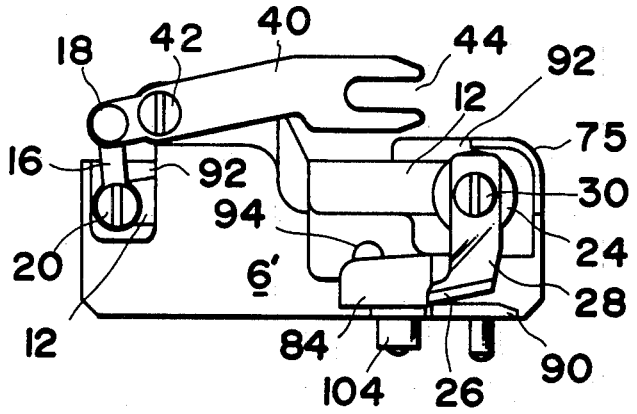
FIG. 8 is an elevation view of the modified trimmer shown in FIG. 6 seen in the direction of an arrow D.

When the needle bar 70 is at its up position, one end of the upper lever arm 40 fastened thereto and pivotably supported by the L-shaped arm 4 by means of the screw 42 as heretofore explained in regard to FIG. 4 is also lifted upward. Simultaneously the other end of the upper lever arm 40 moves downward. Thereby the projected lever arm 14 of the lower lever 12 is lowered with the result that one end of the lower lever 12 which is pivotably supported by the vertical lever stand 6 or the support wall 92 (FIGS. 6–10) is shifted downward as shown in FIG. 4, by the medium of connecting rod link 16 pivotably connecting the upper lever 40 to the projected arm 14 (FIG. 1) of the lower lever 12 while the other end of the lower lever 12 having the cylindrical arm 22 (FIG. 3) is lifted upward whereby the cutter 28 fastened dependingly to the edge 24 (FIGS. 1 and 2) thereof is also lifted upward with its cutter blade 26 touching slidably with the shearing edge 46 of the base arm portion 2' or the shearing edge 90 of the shearing plate 80, as shown in FIG. 2 or FIG. 8 respectively.

Whenever the upper lever 40 is shifted downward by means of reverse motion of the needle bar 70, as shown in FIG. 4, the cutter 28 is shifted downward through the related parts as heretofore explained with its cutter blade 26 (FIGS. 1 and 2) touching slidably with the shearing edge 46 or 90 respectively and by the repeated motion of the cutter blade 26 and shearing edge 46 or 90, the edge of materials M (FIG. 1) which are fed foward by means of a feed dog and a presser foot (not shown) therebetween is being trimmed. Thus the materials M which are fed in the direction of an arrow W by means of a feeding device as shown in FIG. 1 or FIG. 9 are trimmed successively by means of cutter blade 26 and the shearing edge 46 or 90 acting in unison with up and down movement of the needle bar 70 to which one end of the upper lever 40 is connected.

The upright guide wall 48 (FIG. 1) of the cloth guide means 50 or the upright guide wall 84 (FIG. 6) of cloth guide means 82 aids to guide the trimmed materials M to be fed forwardly in a desired direction W as shown in FIG. 1 or FIG. 9. Whenever the cloth materials M are shifted forward, guided by the guide wall 48 or 84, the operator is able to adjust the width of the trimming edge by means of scale-marks 98 (FIG. 9) graduated on a front edge of the cover plate 75. Lockstitch seams are usually formed along the edge of trimmed materials immediately after trimming by utilizing two threads such as a needle thread and a bobbin thread as is known in the prior art. Also, zigzag seams are formed as shown in FIG. 1 by using a zigzag sewing machine.

The trimmer of this invention enables the operator to make stitches along the trimmed edges successively immediately after the completion of trimming operation which may be effectively done by the utilization of oscillating movement of the needle bar 70 of the sewing machine.

For an effective shearing operation, the contact between the cutter blade 26 and the shearing edge 46 (FIG. 2) of the base arm portion 2' or the shearing edge 90 (FIG. 7) of the cloth guide means 82 may have to be adjusted as required by the various thickness or other conditions of cloth materials to be worked upon. This object may be obtained by tightening or loosening the nut 67 (FIG. 5) so that the contact between the cutter blade 26 (FIG. 1) and the shearing edge 46 or 90 may be adjusted through the advancement or retreatment of the nut screw 68 (FIG. 5) into or out of the threaded bore 59 of the cylindrical projection 58 within a limited lengthwise distance of the slit 65 disposed in the cylindrical portion 61 into or out of which the pin 60 is slidably engaged. At the same time a biasing force of the coil spring 66 provided around the cylindrical projection 58 may automatically help maintain a proper contact between the cutting means involved through tightening and loosening the nut 67.

What I claim is:

1. An edge trimmer for a sewing machine having a needle fastened to a needle bar by a clamping screw, said edge trimmer comprising:

a base;

a stand integrally formed on the base;

a lower lever being pivotably supported about a mid-portion thereof by the stand and having two ends;

a link being connected at one end to one of the two ends of the lower lever;

an upper lever pivotably supported about a point between two ends thereof by the stand, said upper lever being connected at one end to an opposing end of the link and being connected at an opposite end to the clamping screw of the needle bar;

a cylindrical arm projecting from the other end of the two ends of the lower lever;

a cutter depending at one end from one end of the cylindrical arm and having a shearing edge at an opposite end for cutting cloth;

means, secured to the base, for guiding cloth into contact with the cutter;

a shearing plate being secured to the base and having a shearing edge;

means, included in the cylindrical arm, for adjusting contact between the shearing edge of the cutter and the shearing edge of the shearing plate; and cover plate means, secured to the base, for protectively extending around the cylindrical arm by leaving a clearance therebetween, said cover plate means having scale marks graduated in equal increments along the front edge thereof;

whereby, whenever cloth is shifted by the guide means, an operator of the sewing machine is able to adjust the width of a trimming edge of the cloth after viewing the scale marks along the front edge of the cover plate means.

2. The edge trimmer according to claim 1 wherein:

said contact adjusting means included in the cylindrical arm comprises:

a cylindrical portion having a bore extending therethrough;

a cylindrical projection being slidable into one end of the bore extending through the cylindrical portion;

a nut having a male screw slidable into an opposing end of the bore extending through the cylindrical portion and engagable with the cylindrical projection therein; and a coil spring provided around the cylindrical projection whenever the nut is engagable with the cylindrical projection in the cylindrical portion;

whereby contact between the shearing edge of the cutter and the shearing edge of the shearing plate may be adjusted so that desired shearing stress between the cutter and the shearing plate may be maintained while cutting cloth fed therebetween by the guiding means.

* * * * *